US008767000B2

(12) United States Patent
Pyo et al.

(10) Patent No.: US 8,767,000 B2
(45) Date of Patent: Jul. 1, 2014

(54) DATA PROCESSING METHOD AND DISPLAY APPARATUS FOR PERFORMING THE SAME

(75) Inventors: Dong-Hak Pyo, Cheonan-si (KR); Tae-Kwon Jung, Asan-si (KR); Dae-Gwang Jang, Incheon (KR); Min-Ha Keum, Cheonan-si (KR); Hak-Mo Choi, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 278 days.

(21) Appl. No.: 13/190,920

(22) Filed: Jul. 26, 2011

(65) Prior Publication Data

US 2012/0194536 A1 Aug. 2, 2012

(30) Foreign Application Priority Data

Feb. 1, 2011 (KR) ..... 10-2011-0010073

(51) Int. Cl.
*G09G 5/02* (2006.01)

(52) U.S. Cl.
USPC ..... 345/589

(58) Field of Classification Search
None
See application file for complete search history.

(56) References Cited

U.S. PATENT DOCUMENTS

| | | | | |
|---|---|---|---|---|
| 7,920,121 | B2 * | 4/2011 | Shen et al. | 345/102 |
| 2004/0080517 | A1 * | 4/2004 | Song et al. | 345/596 |
| 2008/0007565 | A1 * | 1/2008 | Nogawa et al. | 345/597 |
| 2010/0020094 | A1 * | 1/2010 | Park et al. | 345/589 |
| 2010/0060660 | A1 * | 3/2010 | Bae et al. | 345/596 |
| 2010/0253711 | A1 * | 10/2010 | Muroi | 345/690 |
| 2011/0141090 | A1 * | 6/2011 | Hong et al. | 345/211 |

FOREIGN PATENT DOCUMENTS

| | | |
|---|---|---|
| JP | 2001-108962 | 4/2001 |
| JP | 2009-204825 | 9/2009 |
| KR | 1020080022933 A | 3/2008 |
| KR | 102010075046 A | 7/2010 |

* cited by examiner

*Primary Examiner* — Hau Nguyen
*Assistant Examiner* — Ryan M Gray
(74) *Attorney, Agent, or Firm* — F. Chau & Associates, LLC

(57) ABSTRACT

A data processing method compensates a color of input data for a present frame of a display panel of a display apparatus to generate color compensating data. Dimming levels of a plurality of light emitting blocks included in a light source module for the display panel are determined using the color compensating data. Compensating data of the present frame is generated using the color compensating data and compensating coefficient data including the dimming levels.

17 Claims, 7 Drawing Sheets

DATA PROCESSING METHOD AND DISPLAY APPARATUS FOR PERFORMING THE SAME

CROSS REFERENCE TO RELATED APPLICATION

This application claims priority under 35 U.S.C. §119 to Korean Patent Application No. 2011-10073, filed on Feb. 1, 2011 in the Korean Intellectual Property Office (KIPO), the disclosure of which is incorporated by reference in its entirety herein.

BACKGROUND

1. Technical Field

Exemplary embodiments of the present invention relate to a data processing method and a display apparatus for performing the data processing method, and more particularly to a data processing method capable of preventing image distortion and a display apparatus for performing the data processing method.

2. Discussion of Related Art

A liquid crystal display (LCD) panel may include a display substrate, an opposite substrate facing the display substrate, and a liquid crystal layer disposed between the display substrate and the opposite substrate. The display substrate includes a display area in which a plurality of lines and a plurality of transistors connected to the lines are formed, and a peripheral area in which a plurality of pads supply an electric signal to the lines.

An LCD apparatus including the LCD panel may use a light source module disposed below the LCD panel. The light source module may be configured to maintain a uniform luminance.

In a local dimming method, the light source module is divided into a plurality of light emitting blocks and luminance is controlled by each light emitting block. The local dimming method adjusts the luminance of the light provided from the light source module and a transmitting rate of the LCD panel to display an original luminance of an image. The local dimming method adjusts the transmitting rate of pixels correlated with the luminance of the light emitting block to decrease power consumption and to enhance contrast ratio.

The local dimming method includes a data dithering process that uses dithering logic. However, when dithered data is transmitted to a timing controller, the data may be dithered again by a color compensating module of the timing controller. Further, since the dithering performed by the local dimming method may conflict with the dithering performed by the color compensating module, a dithering pattern may be visualized at a boundary of the image, which may reduce image quality.

SUMMARY

According to an exemplary embodiment of the present invention, a data processing method compensates a color of input data of a present frame for a display panel of a display apparatus to generate color compensating data. Dimming levels of plurality of light emitting blocks included in a light source module for the display panel are determined using the color compensating data. Compensating data for the present frame is generated using the color compensating data and compensating coefficient data including the dimming levels.

The input data may be m-bit data, and the color compensating data may be n-bit data, where m and n are natural numbers, and n is greater than m.

The dimming levels may be determined using upper k-bits of the n-bit color compensating data, where k is a natural number less than n, and equal to or greater than m.

The generating of the compensating data may include receiving the n-bit color compensating data and the compensating coefficient data, generating t-bit sub compensating data using the n-bit color compensating data and the compensating coefficient data, where t is a natural number and greater than n.

The compensating coefficient data may include a luminance coefficient corresponding to the dimming levels and the light emitting blocks.

The generating of the compensating data may include dithering the t-bit sub compensating data to generate m-bit compensating data.

The method may include comparing the m-bit compensating data of a present frame with frame compensating data of a previous frame to generate frame compensating data of the present frame.

According to an exemplary embodiment of the present invention, a display apparatus includes a display panel having a plurality of pixels, a light source module, a color compensator, a pulse width modulation (PWM) calculator and a pixel compensator. The light source module includes a plurality of light emitting blocks, and provides the display panel with light. The color compensator compensates a color of input data of a present frame for the display panel to generate color compensating data. The PWM calculator determines dimming levels of the light emitting blocks using the color compensating data. The pixel compensator generates compensating data of the present frame using the color compensating data and compensating coefficient data including the dimming levels.

The display apparatus may include a light source driver driving the light emitting blocks using the dimming levels.

The PWM calculator may generate the compensating coefficient data including a luminance coefficient corresponding to the dimming levels and the light emitting blocks.

The display apparatus may include a dithering unit dithering the t-bit sub compensating data to generate m-bit compensating data.

Alternately, the display apparatus may include a dithering unit dithering the t-bit sub compensating data to generate m-bit compensating data for the present frame and a frame compensator comparing the m-bit compensating data of the present frame with frame compensating data of a previous frame to generate frame compensating data of the present frame.

The frame compensator may include a memory storing the frame compensating data of the previous frame.

The color compensator, the PWM calculator and the pixel compensator may be integrally formed in one driving chip.

The light source module may include a light guiding plate disposed on a rear surface of the display panel and a light emitting module. The light emitting module may be disposed adjacent a longest side of the light guiding plate, and may include the light emitting blocks arranged in a line.

The light source module may include a light guiding plate disposed on a rear surface of the display panel and a light emitting module. The light emitting module may be disposed adjacent a shortest side of the light guiding plate, and may include the light emitting blocks arranged in a line.

The light source module may be disposed on a rear surface of the display panel, and include the light emitting blocks arranged in a plurality of lines.

According to an exemplary embodiment of the present invention, a timing controller for a display apparatus is provided. The timing controller includes a color compensator, a PWM calculator, a pixel compensator, and a dithering unit. The color compensator receives input image data of a frame for a display panel of the display apparatus to generate color compensating data having a higher bit count than the input image data. The PWM calculator receives upper bits of the compensating data to generate compensating coefficient data and a light source control signal for a light source driver of the display panel. A total count of the upper bits is less than the entire compensating data. The compensating coefficient data includes a duty ratio of light emitting blocks of a light source for the display apparatus and luminance information for each light emitting block. The pixel compensator receives the entire compensating data and the compensating coefficient data to generate sub-compensating data. The dithering unit receives the sub-compensating data to generate compensating data for a data driver of the display apparatus.

BRIEF DESCRIPTION OF THE DRAWINGS

The present invention will become more apparent by describing in detailed exemplary embodiments thereof with reference to the accompanying drawings, in which.

DETAILED DESCRIPTION

Hereinafter, exemplary embodiments the present invention will be explained in detail with reference to the accompanying drawings.

Figure 1:
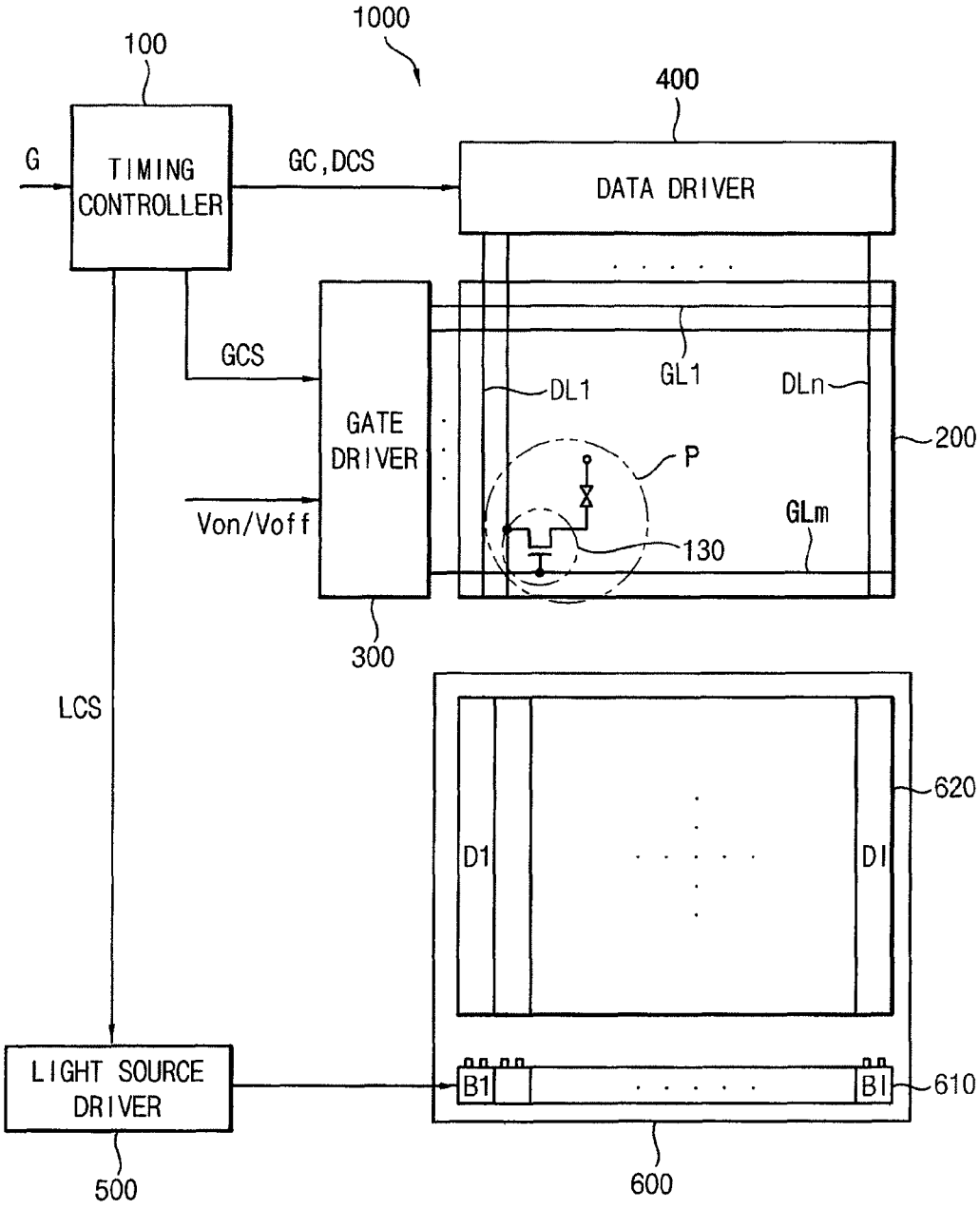
FIG. 1 is a block diagram illustrating a display apparatus according to an exemplary embodiment of the present invention.

FIG. 1 is a block diagram illustrating a display apparatus according to an exemplary embodiment of the present invention. Referring to FIG. 1, a display apparatus 1000 includes a timing controller 100, a display panel 200, a gate driver 300, a data driver 400, a light source driver 500 and a light source module 600.

The timing controller 100 compensates a color of input data G to generate color compensating data, and determines dimming levels of a plurality of light emitting blocks B included in the light source module 600 based on the color compensating data to generate a light source control signal LCS. The light source control signal LCS is provided to the light source driver 500. In addition, the timing controller 100 generates compensating data GC using the color compensating data and the determined dimming levels.

The timing controller 100 provides the gate driver 300 with a gate control signal GCS. The timing controller 100 provides the data driver 400 with the compensating data GC and a data control signal DCS. The gate and data control signals GCS and DCS control a display of the display panel 200.

The display panel 200 displays an image based on data signals from the data driver 400 and gate signals from the gate driver 300. The display panel 200 includes a plurality of gate lines GL1~GLm, a plurality of data lines DL1~DLn and a plurality of pixels P. The gate lines GL1~GLm extend along a first direction D1. The data lines DL1~DLn extend along a second direction D2 crossing the first direction D1. In at least one exemplary embodiment of the invention, each of the pixels P includes a switching element 130 connected to a corresponding one of the gate and data lines GL1~GLm and DL1~DLn and a pixel electrode (not shown) electrically connected to the switching element 130.

The gate driver 300 may be connected to end portions of the gate lines GL1~GLm. The gate driver 300 generates the gate signals using the gate control signal GCS provided from the timing controller 100 and gate on/off voltages Von/Voff provided from a voltage generator (not shown). As an example, the gate driver 300 may sequentially apply the gate signals to the gate lines GL1~GLm arranged on the display panel 200. The gate driver 300 may include a plurality of gate driving integrated circuits ICs (not shown). The gate driving ICs may include multiple switching elements formed in a peripheral area of the display panel 100. The switching element 230 of a pixel P in a display area of the display panel 100 may be formed at the same time the switching elements of the gate driving ICs are formed.

The data driver 400 may be connected to end portions of the data lines DL1~DLn. The data driver 400 receives the compensating data GC and the data control signal DCS from the timing controller 100, and grayscale voltages from a grayscale voltage generator (not shown). The data driver 400 converts the compensating data GC into an analogue data voltage based on the grayscale voltages, and applies the analogue data voltage to the data lines DL1~DLn arranged on the display panel 200. The data driver 400 may include a plurality of data driving ICs (not shown).

The light source driver 500 drives the light source 600 using the light source control signal LCS provided from the timing controller 100. The light source driver 500 may individually control the light emitting blocks B of the light source 600 based on the light source control signal LCS.

The light source 600 provides the display panel 200 with light. The light source 600 includes a light emitting module 610 and a light guiding plate 620. As an example, the light emitting module 610 may include a fluorescent lamp or a light emitting diode. The light emitting module 610 may be disposed adjacent a relatively longer edge of the light guiding plate 620. For example, if the light guiding plate 620 has a rectangular shape, the light emitting module 610 may be located near the edge of the longest side.

The light emitting module 610 is divided into the light emitting blocks B. The luminance of each of the light emitting blocks B may be individually controlled to be driven via a local dimming method. The light emitting module 610 as shown in FIG. 1 may have a one-dimensional local dimming structure including I number of the light emitting blocks B1, . . . , BI arranged along the first direction D1, where I is a natural number. For example, the light emitting blocks B may be arranged in a single row. However, embodiments of the present invention are not limited to any particular arrangement of the light emitting blocks B.

The light guiding plate 620 includes a plurality of light guiding blocks D respectively corresponding to the light emitting blocks B. For example, in at least one embodiment, there is one light guiding block D for each one light emitting block B. The light guiding plate 620 guides light generated from the light emitting module 610 toward the display panel 200.

Figure 2:
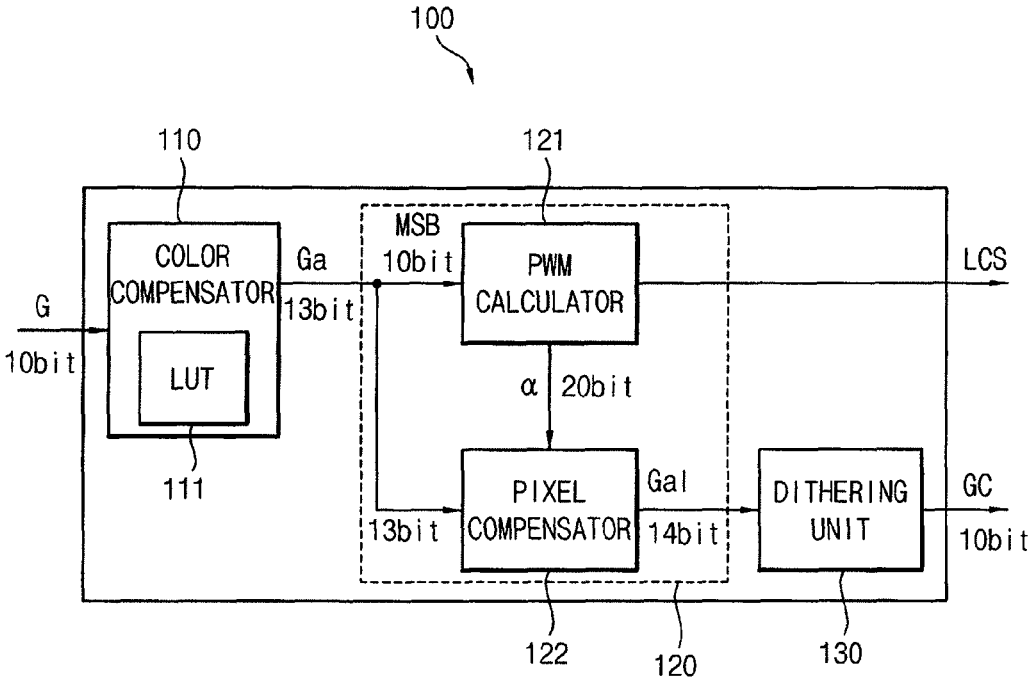
FIG. 2 is a block diagram illustrating a timing controller of FIG. 1 according to an exemplary embodiment of the present invention.

FIG. 2 is a block diagram illustrating a timing controller of FIG. 1 according to an exemplary embodiment of the invention. Referring to FIG. 2, the timing controller 100 includes a color compensator 110, a local dimming controller 120 and a dithering unit 130. The local dimming controller 120 includes a pulse width modulation (PWM) calculator 121 and a pixel compensator 122.

The color compensator 110 performs a color compensating process to compensate colors to maintain a color balance. The color compensating process may decrease or eliminate a color characteristic shift based on changes in grayscale to maintain the color balance.

The color compensator 110 receives input data G on each color from an external source. The input data may include a number of bits. For example, in FIG. 2, the input data G is 10-bit data. However, embodiments of the present invention are not limited to data of any particular size. During an initial driving of the display apparatus, the color compensator 110 converts the input data G into color compensating data Ga. The color compensator 110 may store the color compensating data Ga in a look-up table (LUT) 111. After the initial driving, the color compensator 110 receives the input data G for each color (e.g., from an external source) to output the color compensating data Ga corresponding to each input data G.

For example, the input data G is m-bit data, where m is a natural number. The LUT 111 stores the color compensating data Ga corresponding to each of the grayscales of the input data G. The number of bits of the color compensating data Ga is greater than or equal to k, where k is a natural number that is greater than m. For example, when the input data G is 10-bit data, the color compensating data Ga may be 13-bit data.

When the input data G is converted into data having bits greater than the input data G, color compensating may be more effective. For example, when the color compensating data Ga is 10-bit data, the display panel 200 represents 1024 grayscales. When the color compensating data Ga is 13-bit data, the display panel 200 represents 4096 grayscales.

In an exemplary embodiment, the input data G has 10 bits and the color compensating data Ga has 13 bits. However, embodiments of the invention are not limited to any particular number of input data bits or color compensating bits, and may be variously changed. For example, the input data G could be 8-bit data and the corresponding color compensating data could be 11-bit data, 12-bit data, etc.

The color compensator 110 outputs upper bits of the k-bit color compensating data Ga to the PWM calculator 121, and outputs the k-bit color compensating data Ga to the pixel compensator 122. For example, the upper t-bit data of the k-bit color compensating data Ga may be output to the PWM calculator 121, where t is less than k, and equal to or greater than m. For example, the upper 10-bit data of the 13-bit color compensating data Ga may be output to the PWM calculator 121. However, embodiments of the invention are not limited to upper bit data of any particular size.

The PWM calculator 121 divides the color compensating data Ga received from the color compensator 110 into a plurality of image blocks respectively corresponding to the light emitting blocks B of the light source module 600. The PWM calculator 121 receives the upper-t bits of the k-bits color compensating data per pixel.

The PWM calculator 121 calculates a representative grayscale of the image block using a histogram according to the grayscale of the color compensating data Ga included in each image block. The representative grayscale may be an average grayscale or a maximum grayscale of the color compensating data Ga included in the image block. The PWM calculator 121 determines dimming levels of the light emitting blocks B using the representative grayscales of the image blocks. Although not shown in the figures, the PWM calculator 121 may temporally and spatially compensate the dimming level using a low-pass filter.

The PWM calculator 121 may generate driving signals driving each of the light emitting blocks B of the light source module 600 using the dimming levels. Each of the driving signals may be a PWM signal which is modulated as a pulse-width, and the dimming level may correspond to a duty ratio of the PWM signal. The PWM calculator 121 provides the light source driver 500 with the light source control signal LCS including the driving signals.

In addition, the PWM calculator 121 provides the pixel compensator 122 with compensating coefficient data $\alpha$. The compensating coefficient data $\alpha$ includes the duty ratio of the light emitting blocks B and a luminance coefficient corresponding to each of the light emitting blocks B. For example, the compensating coefficient data $\alpha$ may be 20-bit data. However, exemplary embodiments of the invention are not limited to compensating coefficient data $\alpha$ of any particular size.

The pixel compensator 122 receives the k-bit color compensating data Ga from the color compensator 110, and the compensating coefficient data $\alpha$ from the PWM calculator 121. In at least one exemplary embodiment, the pixel compensator 122 determines a luminance of each pixel of the display panel 200 using a luminance distribution of light based on the compensating coefficient data $\alpha$. However, in alternate embodiments, the pixel compensator 122 may determine the luminance for a smaller subset of the pixels. Hereinafter, the luminance of each pixel is referred to as a pixel luminance. The pixel compensator 122 compensates the k-bit color compensating data Ga input from the color compensator 110 using the pixel luminance to generate n-bit sub compensating data Ga1, where n is a natural number. For example, the pixel compensator 122 may calculate the 13-bit color compensating data Ga received from the color compensator 110 and the 20-bit compensating coefficient data $\alpha$ received from the PWM calculator 121 to generate the 14-bit sub compensating data Ga1. However, embodiments of the present invention are not limited to sub compensating data Ga1 of any particular size.

The pixel compensator 122 outputs the n-bit sub compensating data Ga1 to the dithering unit 130. The dithering unit 130 prevents the sub compensating data Ga1 from being saturated with the grayscales having a relatively high luminance, and dithers the sub compensating data Ga1 to represent all grayscales.

The dithering unit 130 temporally and spatially compensates the n-bit sub compensating data Ga1 to generate m-bit compensating data GC, and outputs the m-bit compensating data GC to the data driver 400. While FIG. 2 shows the compensating data GC to have a same bit count as the input data G, alternate embodiments of the invention are not limited thereto. For example, the dithering unit 130 may generate compensating data GC having a number of bits different from that of the input data G, and output the compensating data GC to the data driver 400.

For example, when the color compensator 110 receives the 10-bit input data G, the dithering unit 130 may output the 10-bit compensating data GC having substantially the same number of bits as the inputted data G. Alternatively, when the color compensator 110 receives the 10-bit input data G the dithering unit 130 may output 8-bit compensating data GC having the number of bits different from the 10-bit input data G. Alternatively, when the color compensator 110 receives 8-bit input data G, the dithering unit 130 may output the 10-bit compensating data GC by expanding the 8-bit input data G.

Table 1 is a table of driving modes of the timing controller of FIG. 1. In the table, the term "LCON" refers to a local dimming controller (e.g., 120), the term "COLOR COM." refers to the color compensator 110, the term "PWM BLOCK" refers to the PWM calculator 121, the term "PIXEL COM." refers to the pixel compensator 122, and the term "DITHER" refers to the dithering unit 130.

Referring to Table 1, when the color compensator 110 and the local dimming controller 120 are used together, the driving of the timing controller 100 is as follows (see e.g., first three rows of Table 1).

When the compensating data GC is output as 8-bit data, the dithering unit 130 compensates the 14-bit sub compensating data Ga1 to 10-bit data, and converts the lower 2-bits of the 10-bit data to "00." When the compensating data GC is output as 10-bit data, the dithering unit 130 compensates the 14-bit sub compensating data Ga1 to 10-bit data, and outputs the 10-bit data as the compensating data GC.

In addition, when the input data G is 8-bit data, the color compensator 110 converts the lower 2-bits of the 10-bit color compensating data Ga output to the PWM calculator 121 to "11."

TABLE 1

| COLOR COM. ON/OFF | LCON ON/OFF | INPUT BIT WIDTH | OUTPUT BIT WIDTH | COLOR COM. OUTPUT (LCON INPUT) | PWM BLOCK INPUT | PIXEL COM. INPUT | DITHER INPUT | DITHER OUTPUT (LAST OUTPUT) |
|---|---|---|---|---|---|---|---|---|
| ON | ON | 10 bit | 10 bit | 13 bit | 10 bit | 13 bit | 14 bit | 10 bit |
| ON | ON | 10 bit | 8 bit | 13 bit | 10 bit | 13 bit | 14 bit | (8 bit, 2b00) |
| ON | ON | 8 bit | 8 bit | 13 bit | (8 bit, 2b11) (LCON) | 13 bit | 14 bit | (8 bit, 2b00) |
| ON | OFF | 10 bit | 10 bit | 13 bit | DON'T CARE (LCON BYPASS) | DON'T CARE (LCON BYPASS) | (13 bit, 1d0) (DITHER ON) | 10 bit |
| ON | OFF | 10 bit | 8 bit | 13 bit | DON'T CARE (LCON BYPASS) | DON'T CARE (LCON BYPASS) | (13 bit, 1d0) (DITHER ON) | (8 bit, 2b00) |
| ON | OFF | 8 bit | 8 bit | 13 bit | DON'T CARE (LCON BYPASS) | DON'T CARE (LCON BYPASS) | (13 bit, 1d0) (DITHER ON) | (8 bit, 2b00) |
| OFF | ON | 10 bit | 10 bit | (10 bit, 3d0) | 10 bit | (10 bit, 3d0) | 14 bit | 10 bit |
| OFF | ON | 10 bit | 8 bit | (10 bit, 3d0) | 10 bit | (10 bit, 3d0) | 14 bit | (8 bit, 2b00) |
| OFF | ON | 8 bit | 8 bit | (8 bit, 5d0) | (8 bit, 2b11) | (8 bit, 2b11, 3do) | 14 bit | (8 bit, 2b00) |
| OFF | OFF | 10 bit | 10 bit | (10 bit, 3d0) | DON'T CARE (LCON BYPASS) | DON'T CARE (LCON BYPASS) | (10 bit, 4d0) | 10 bit |
| OFF | OFF | 10 bit | 8 bit | (10 bit, 3d0) | DON'T CARE (LCON BYPASS) | DON'T CARE (LCON BYPASS) | (10 bit, 4d0) | (8 bit, 2b00) |
| OFF | OFF | 8 bit | 8 bit | (8 bit, 5d0) | DON'T CARE (LCON BYPASS) | DON'T CARE (LCON BYPASS) | (10 bit, 4d0) | (8 bit, 2b00) |

The timing controller 100 supports various modes. For example, the timing controller supports a method in which the color compensator 110 and the local dimming controller 120 are individually used, or a method according to an exemplary embodiment in which the color compensator 110 and the local dimming controller 120 are used together.

Referring to Table 1, in the driving of the timing controller 100, the input data G and the compensating data GC are 8-bit data or 10-bit data, the color compensating data Ga is 13-bit data, the data input to the PWM calculator 121 is 10-bit data, the sub compensating data Ga1 is 14-bit data, and the dithering unit 130 outputs 10-bit data. However, embodiments of the present invention are not limited data of any particular bit size, and may vary with respect to the values shown in Table 1.

When the local dimming controller 120 is turned off and the color compensator 110 is turned on, the driving of the timing controller 100 is as follows (see e.g., rows 4-6 of Table 1).

The color compensator 110 outputs the 13-bit color compensating data Ga. The pixel compensator 122 adds "0" as a least significant bit to the 13-bit color compensating data Ga to generate the 14-bit sub compensating data Ga1. The pixel compensator 122 outputs the 14-bit sub compensating data Ga1 to the dithering unit 130. The dithering unit 130 compensates the 14-bit sub compensating data Ga1 to generate the compensating data GC having 8-bit or 10-bit data and outputs the compensating data GC.

Since the dimming levels have not yet been calculated, the light emitting blocks B of the light source module are driven at a duty ratio of about 100%.

When the local dimming controller 120 is turned on and the color compensator 110 is turned off, the driving of the timing controller 100 is as follows (see e.g., rows 7-9 of Table 1).

Since the color compensating process is not performed, the color compensator 110 generates the 13-bit color compensating data Ga having its lower 3-bits or 5-bits set to "0." The PWM calculator 121 receives the upper 10-bits of the 13-bit color compensating data Ga. When the input data G is 8-bit data, the PWM calculator 121 receives the upper 10-bits of the 13-bit color compensating data, and the lower 2-bits of the upper 10-bit data are converted to "11." When the compensating data GC is output as 8-bit data, the dithering unit 130 compensates the 14-bit sub compensating data Ga1 to 10-bit data, and converts the lower 2-bits of which to "00."

When the local dimming controller 120 and the color compensator 110 are both turned off (e.g., see rows 10-12 of Table 1), the input data G is output as the compensating data GC. When the compensating data GC is output as 8 bit data, the dithering unit 130 outputs data, where the lower 2-bits of which is set to "00."

When the color compensator and the local dimming controller are individually used, so that each of the color compensator and the local dimming controller individually performs the dithering process, a dithering pattern may be visualized. However, according to an exemplary embodiment, the local dimming controller 120 and the color compensator 110 cooperate in the timing controller 100, so that the dithering process is performed once. Thus, visualization of the dithering pattern due to the conflicting dithering processes may be prevented.

In addition, the PWM calculator 121 uses upper bit data of the color compensating data Ga, and the color compensator 110 generates the color compensating data Ga by expanding the input data G. Therefore, the number of bits of the data input to the PWM calculator 121 may be maintained. The PWM calculator 121 may perform more calculations that other units of the local dimming controller 120. Since the local dimming controller 120 and the color compensator 110 can cooperate with one another, the number of the dithering processes performed may be minimized.

Figure 3:
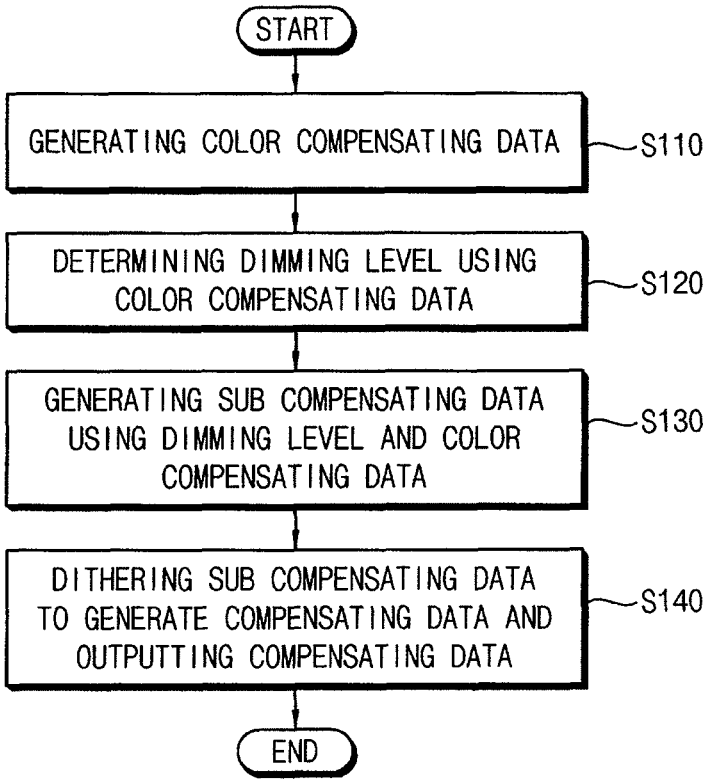
FIG. 3 a flow chart for explaining a method for processing data of the display apparatus of FIG. 1 according to an exemplary embodiment of the present invention.

FIG. 3 a flow chart for explaining a method for processing data of the display apparatus of FIG. 1. Referring to FIG. 3, the color compensator 110 compensates colors of the input data G to generate color compensating data Ga (step S110). The color compensator 110 receives input data having a number of bits for each color. The input data may be received from an external source. During an initial driving of the display apparatus, the color compensator 110 converts the input data into the color compensating data Ga. The color compensator 110 may store the color compensating data Ga in the LUT 111. After the initial driving of the LCD apparatus, the color compensator 110 receives the m-bit input data G for each color to output the k-bit color compensating data Ga corresponding to each of the input data G.

The PWM calculator 121 divides the color compensating data Ga received from the color compensator 110 into the image blocks respectively corresponding to the light emitting blocks B of the light source module 600. The PWM calculator 121 receives the upper-t bits of the k-bits color compensating data per pixel. The PWM calculator 121 calculates the representative grayscale of the image block using a histogram according to the grayscale of the color compensating data Ga included in each image block. The PWM calculator 121 determines the dimming levels of the light emitting blocks B using the representative grayscales of the image blocks (step S120). The PWM calculator 121 generates the light source control signal LCS including the driving signals, and provides the light source control signal LCS to the light source driver 500. In addition, the PWM calculator 121 provides the pixel compensator 122 with the compensating coefficient data α. The compensating coefficient data α includes the duty ratio of the light emitting blocks B and a luminance coefficient corresponding to each of the light emitting blocks B.

The pixel compensator 122 generates the n-bit sub compensating data Ga1 using the compensating coefficient data α and the k-bit color compensating data Ga (step S130). The pixel compensator 122 determines the pixel luminance using a luminance distribution of light based on the compensating coefficient data α. The pixel luminance may be provided to one or more pixels P of the display panel 200. The pixel compensator 122 compensates the k-bit color compensating data Ga input from the color compensator 110 using the pixel luminance to generate the n-bit sub compensating data Ga1. The pixel compensator 122 outputs the n-bit sub compensating data Ga1 to the dithering unit 130.

The dithering unit 130 temporally and spatially compensates the n-bit sub compensating data Ga1 to generate the compensating data GC, and outputs the compensating data GC to the data driver 400 (step S140). The dithering unit 130 dithers the sub compensating data Ga1 having more bits than the input data G to generate the compensating data GC suitable for the data driver 400, and outputs the compensating data GC to the data driver 400.

According to an exemplary embodiment, the color compensating process and the local dimming process cooperate in the timing controller 100, so that the dithering process is performed once. Thus, visualization of a dithering pattern by dithering processes conflicting with each other may be prevented.

In addition, the PWM calculator 121 uses upper bit data of the color compensating data Ga. Therefore, the number of bits of the data input to the PWM calculator 121 is maintained. The PWM calculator 121 may perform a larger number of calculations than other units of the local dimming controller 120. The local dimming controller 120 and the color compensator 110 cooperate with one another, so that the number of dithering processes performed may be minimized.

Figure 4:
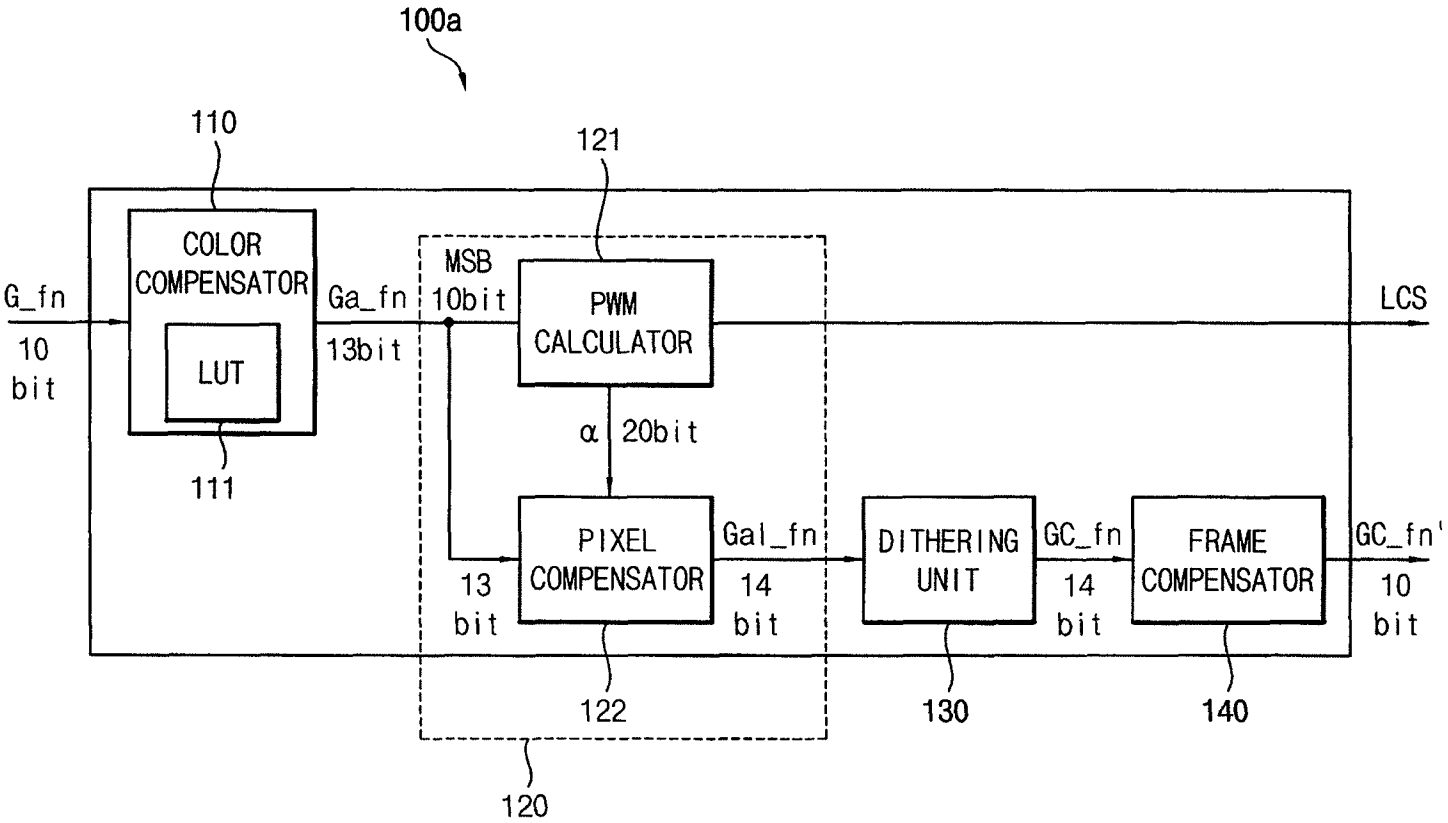
FIG. 4 is a block diagram illustrating a timing controller according to an exemplary embodiment of the present invention.
Figure 5:
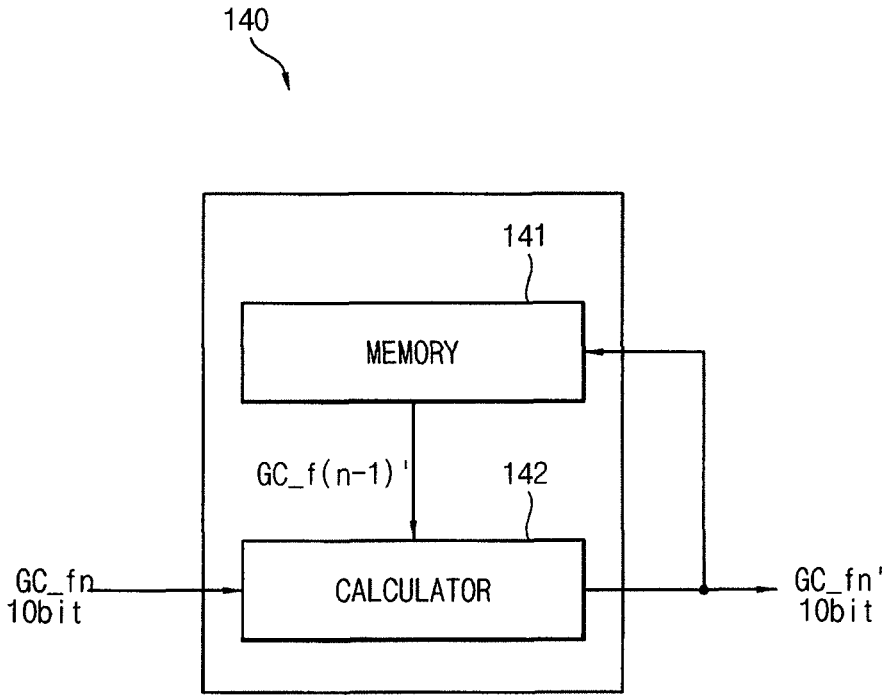
FIG. 5 is a block diagram illustrating a frame compensator of FIG. 4 according to an exemplary embodiment of the present invention.

FIG. 4 is a block diagram illustrating a timing controller 100*a* according to an exemplary embodiment of the present invention. FIG. 5 is a block diagram illustrating a frame compensator of FIG. 4 according to an exemplary embodiment of the present invention.

The timing controller 100*a* is substantially the same as the timing controller 100 of FIG. 1 except for a frame compensator. Accordingly, the same reference numerals will be used to refer to the same or like parts in FIG. 4 as those described in FIG. 1.

Referring to FIG. 4, the timing controller 100*a* includes a color compensator 110, a local dimming controller 120, a dithering unit 130 and a frame compensator 140. The local dimming controller 120 includes a PWM calculator 121 and a pixel compensator 122.

The color compensator 110 receives input data of a present frame G_fn, and compensates the input data of the present frame G_fn to output color compensating data of the present frame Ga_fn corresponding to the input data of the present frame G_fn. For example, the input data of the present frame G-fn is m-bit data, where m is a natural number. The color compensating data of the present frame Ga_fn is k-bit data, where k is natural number and greater than m.

In the following example, the input data of the present frame G-fn is 10-bit data, and the color compensating data of the present frame Ga_fn is 13-bit data. However, embodiments of the invention are not limited to input data or compensating data of any particular size.

The color compensator 110 outputs upper bits of the k-bit color compensating data of the present frame Ga_fn to the PWM calculator 121, and outputs the k-bit color compensating data of the present frame Ga_fn to the pixel compensator 122. For example, the upper t-bits of the k-bit color compensating data of the present frame Ga_fn may be output to the PWM calculator 121, where t is less than k, and equal to or greater than m. For example, the upper 10-bits of the 13-bit color compensating data of the present frame Ga_fn may be output to the PWM calculator 121.

The PWM calculator 121 divides the color compensating data of the present frame Ga_fn received from the color compensator 110 into the image blocks respectively corresponding to the light emitting blocks B of the light source module 600. The PWM calculator 121 receives the upper-t bits of the k-bits color compensating data per pixel.

The PWM calculator 121 calculates a representative grayscale of the image block using a histogram according to the grayscale of the color compensating data of the present frame Ga_fn included in each image block. The PWM calculator 121 determines dimming levels of the light emitting blocks B using the representative grayscales of the image blocks.

The PWM calculator 121 may generate driving signals driving each of the light emitting blocks B of the light source module 600 using the dimming levels, and provides the light source driver 500 with the driving signals.

In addition, the PWM calculator 121 provides the pixel compensator 122 with compensating coefficient data α. The compensating coefficient data α includes the duty ratio of the light emitting blocks B and a luminance coefficient corresponding to each of the light emitting blocks B. For example, the compensating coefficient data α may be 20 bit data.

The pixel compensator 122 receives the k-bit color compensating data of the present frame Ga_fn from the color compensator 110 and the compensating coefficient data α from the PWM calculator 121.

The pixel compensator 122 determines a pixel luminance using a luminance distribution of light based on the compensating coefficient data α. The pixel luminance may be provided to all or one or more pixels of the display panel 200. The pixel compensator 122 compensates the k-bit color compensating data of the present frame Ga_fn input from the color compensator 110 using the pixel luminance to generate n-bit sub compensating data of the present frame Ga1_fn, where n is a natural number.

For example, the pixel compensator 122 may receive the 13-bit color compensating data of the present frame Ga_fn from the color compensator 110 and the 20-bit compensating coefficient data α from the PWM calculator 121 to generate the 14-bit sub compensating data of the present frame Ga1_fn. The pixel compensator 122 outputs the n-bit sub compensating data of the present frame Ga1_fn to the dithering unit 130.

The dithering unit 130 temporally and spatially compensates the n-bit sub compensating data of the present frame Ga1_fn to generate m-bit compensating data of the present frame GC_fn, and outputs the m-bit compensating data of the present frame GC_fn to the frame compensator 140. The dithering unit 130 may generate compensating data of the present frame GC_fn having a number of bits different from that of the input data of the present frame G_fn for output to the frame compensator 140.

The frame compensator 140 compensates the compensating data of the present frame GC_fn to generate frame compensating data of the present frame GC_fn', and outputs the frame compensating data of the present frame GC_fn' to the data driver 400.

Referring to FIG. 5, the frame compensator 140 may include a memory 141 and a calculator 142. The memory 141 stores frame compensating data of a previous frame GC_f(n−1) during one frame, and outputs the frame compensating data of the previous frame GC_f(n−1) to the calculator 142.

The calculator 142 generates the frame compensating data of the present frame GC_fn' using the frame compensating data of the previous frame GC_f(n−1)' and the compensating data of the present frame GC_fn. For example, the calculator 142 may include a LUT (not shown) including grayscale values. The grayscale values correspond to a combination of a plurality of grayscales corresponding to the compensating data of the present frame GC_fn and a plurality of grayscales corresponding to the frame compensating data of the previous frame GC_f(n−1)'. When the compensating data of the present frame GC_fn corresponds to a grayscale A, and the frame compensating data of the previous frame GC_f(n−1)' corresponds to a grayscale B, the calculator 142 determines a grayscale of the present frame by referring to the LUT to generate the frame compensating data of the present frame GC_fn'. The grayscale of the present frame corresponds to a combination of grayscales A and B.

The calculator 142 outputs the frame compensating data of the present frame GC_fn' to the data driver 400 and the memory 141. The data driver 400 displays an image on the display panel 200 based on the frame compensating data of the present frame GC_fn'. The memory 141 stores the frame compensating data of the present frame GC_fn' until data of a next frame is input.

According to an exemplary embodiment, the color compensating process and the local dimming process cooperate in the timing controller, so that the dithering process is performed once. Thus, visualization of a dithering pattern by dithering processes conflicting with each other may be prevented.

In addition, the PWM calculator 121 uses upper bits of the color compensating data Ga_fn. Therefore, the number of bits of the data input to the PWM calculator 121 may be maintained. The PWM calculator 121 may perform a larger number of calculations than other units of the local dimming controller 120. The local dimming controller 120 and the color compensator 110 cooperate with one another, so that the number of dithering processes performed may be minimized.

The timing controller 100*a* may compensate an image of a present frame using an image of the previous frame, so that a response rate of the display apparatus is enhanced.

Figure 6:
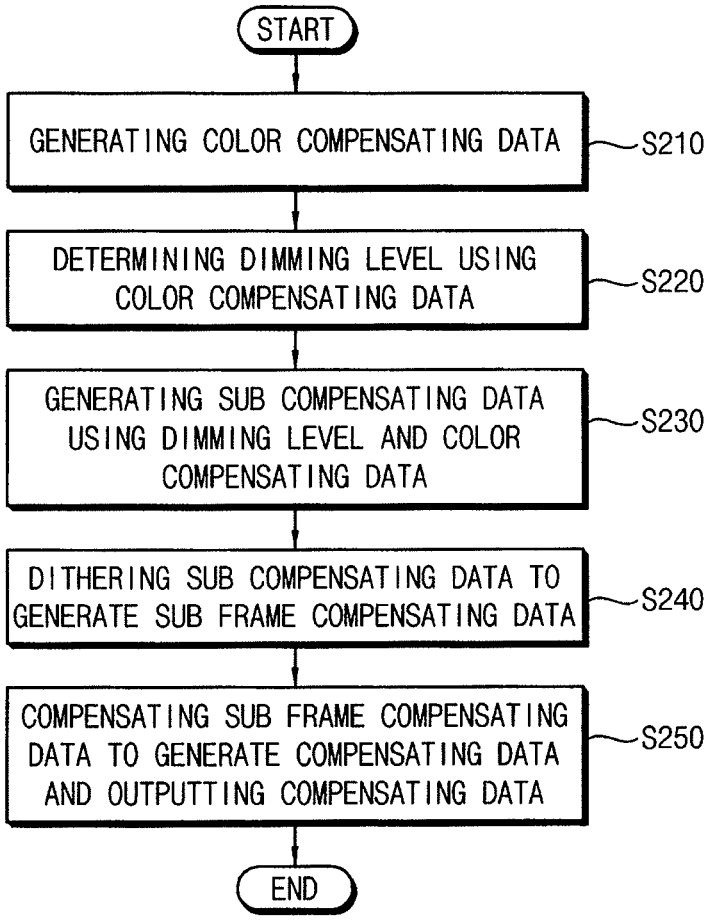
FIG. 6 a flow chart for explaining a method for processing data according to an exemplary embodiment of the present invention.

FIG. 6 a flow chart for explaining a method for processing data according to an exemplary embodiment of the present invention. The method is substantially the same as the method for processing data according to the embodiment described with reference to FIG. 3 except for use of frame compensation data, so the same reference numerals will be used to refer to the same or like parts as those described with respect to FIG. 3.

Referring to FIG. 6, the color compensator 110 compensates colors of the m-bit input data of the present frame G_fn to generate the k-bit color compensating data of the present frame Ga_fn (step S210).

The PWM calculator 121 determines the dimming levels using the upper t-bit data of the k-bit color compensating data of the present frame Ga_fn received from the color compensator 110 (step S220).

The pixel compensator 122 generates the n-bit sub compensating data of the present frame Ga1_fn using the compensating coefficient data α received from the PWM calculator 121 and the k-bit color compensating data of the present frame Ga_fn received from the color compensator 110 (step S230).

The dithering unit 130 temporally and spatially compensates the n-bit sub compensating data of the present frame Ga1_fn to generate the compensating data of the present frame GC_fn, and outputs the compensating data of the present frame GC_fn to the frame compensator (step S240).

The frame compensator 140 compensates the compensating data of the present frame GC_fn to generate the frame compensating data of the present frame GC_fn', and outputs the frame compensating data of the present frame GC_fn' to the data driver 400 (step S250).

According to an exemplary embodiment, the color compensating process and the local dimming process cooperate in the timing controller, so that the dithering process is performed once. Thus, visualization of a dithering pattern by dithering processes conflicting with each other may be prevented.

In addition, the PWM calculator 121 uses upper bits of the color compensating data Ga. Therefore, the number of bits of the data input to the PWM calculator 121 may be maintained. The PWM calculator 121 may perform a larger number of calculations than other units of the local dimming controller 120. The local dimming controller 120 and the color compensator 110 cooperate with one another, so that the number of dithering processes performed may be minimized, and a response rate of the display apparatus may be enhanced.

Figure 7:
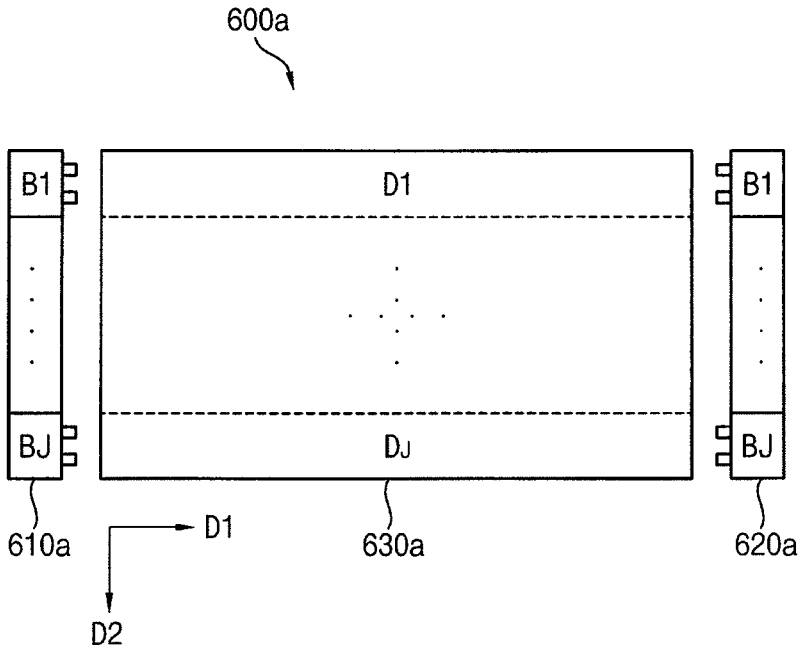
FIG. 7 is a conceptual diagram of a light source module of a display apparatus according to an exemplary embodiment of the present invention.

FIG. 7 is a conceptual diagram of a light source module of a display apparatus according to an exemplary embodiment of the present invention. The display apparatus is substantially the same as the display apparatus described with reference to FIGS. 1 and 2 except for a light source module, so the same reference numerals will be used to refer to the same or like parts as those described with reference to FIGS. 1 and 2.

Referring to FIGS. 1 and 7, a light source module 600*a* includes first and second light emitting modules 610*a* and 620*a* and a light guiding plate 630*a*. The first and second light emitting modules 610*a* and 620*a* are respectively disposed adjacent relatively shorter edges of the light guiding plate 630*a*. As an example, the first and second light emitting modules 610*a* and 620*a* may include a fluorescent lamp or a light emitting diode.

The first and second light emitting modules 610*a* and 620*a* are respectively divided into the light emitting blocks B. Each luminance of the light emitting blocks may be individually controlled to be driven via a local dimming method. The first and second light emitting modules 610*a* and 620*a* as shown in FIG. 7 may have a one-dimension local dimming structure including J-number of the light emitting blocks B1, . . . , BJ arranged along the second direction D2, where J is a natural number.

The light guiding plate 630*a* includes a plurality of light guiding blocks D corresponding to the light emitting blocks B. The light guiding plate 630*a* guides light generated from the first and second light emitting modules 610*a* and 620*a* toward the display panel 200.

Figure 8:
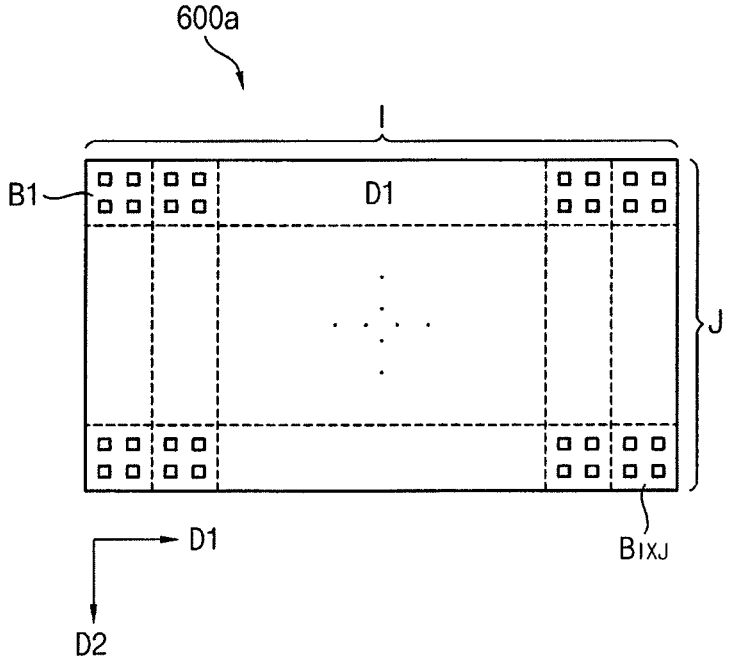
FIG. 8 is a conceptual diagram of a light source module of a display apparatus according to an exemplary embodiment of the present invention.

FIG. 8 is a conceptual diagram of a light source module of a display apparatus according to an exemplary embodiment of the present invention. A display apparatus according to an exemplary embodiment is substantially the same as the display apparatus according to the embodiment described referring to FIGS. 1 and 2 except for a light source module, so the same reference numerals will be used to refer to the same or like parts as those described with respect to FIGS. 1 and 2.

Referring to FIGS. 1 and 8, a light source module 600*b* is divided into the light emitting blocks B. Each luminance of the light emitting blocks may be individually controlled to be driven via a local dimming method. The light emitting block B may include at least one light emitting diode. The light emitting diodes may be disposed on a rear surface of the display panel, and have a 2-dimensional matrix structure. The light source module 600*b* as shown in FIG. 9 may have a 2-dimensional local dimming structure including I-number of the light emitting blocks B arranged along the first direction D1 and J-number of the light emitting blocks B arranged along the second direction D2, so that the light source module 600*b* includes a total of I×J number of the light emitting blocks ($B_1, \ldots, B_{I\times J}$).

According an exemplary embodiment of the present invention, the color compensating process and the local dimming process cooperate with one another in the timing controller, so that the dithering process is performed once. Thus, visualization of a dithering pattern due to dithering processes conflicting with each other may be prevented.

In addition, the PWM calculator 121 uses upper bits of the color compensating data Ga. Therefore, the number of bits of the data input to the PWM calculator 121 may be maintained. The PWM calculator 121 may perform more calculations than other units of the local dimming controller 120. The local dimming controller 120 and the color compensator 110 cooperate with one another, so that the number of dithering processes performed may be minimized, and a response rate of the display apparatus may be enhanced.

Having described exemplary embodiments of the present invention, those skilled in the art will readily appreciate that many modifications can be made in the exemplary embodiments without materially departing from the present invention. Accordingly, all such modifications are intended to be included within the scope of the present invention.

What is claimed is:

1. A data processing method comprising:

compensating a color of input data of a present frame for a display panel of a display apparatus to generate color compensating data;

determining dimming levels of a plurality of light emitting blocks included in a light source module for the display panel using the color compensating data; and generating compensating data for the present frame using the color compensating data, and compensating coefficient data including the dimming levels and a duty ratio of the light emitting blocks, wherein the input data is m-bit data, the color compensating data is n-bit data, m and n are natural numbers, and n is greater than m, and wherein determining the dimming levels comprises determining the dimming levels using upper k-bits of the n-bit color compensating data, wherein k is a natural number less than n and equal to or greater than m.

2. The method of claim 1, wherein generating the compensating data comprises:

receiving the n-bit color compensating data and the compensating coefficient data; and generating t-bit sub compensating data using the n-bit color compensating data and the compensating coefficient data, wherein, t is a natural number and greater than n.

3. The method of claim 2, wherein the compensating coefficient data comprises a luminance coefficient corresponding to the dimming levels and the light emitting blocks.

4. The method of claim 2, wherein generating the compensating data comprises: dithering the t-bit sub compensating data to generate the m-bit compensating data.

5. The method of claim 2, further comprising: comparing the m-bit compensating data of the present frame with frame compensating data of a previous frame to generate frame compensating data of the present frame.

6. The data processing method of claim 1, wherein a pulse width modulation calculator determines the dimming levels.

7. A display apparatus comprising:

a display panel including a plurality of pixels;

a light source module including a plurality of light emitting blocks and providing the display panel with light;

a color compensator compensating a color of input data of a present frame for the display panel to generate color compensating data;

a pulse width modulation (PWM) calculator determining dimming levels of the light emitting blocks using the color compensating data; and a pixel compensator generating compensating data of the present frame using the color compensating data, and compensating coefficient data including the dimming levels and a duty of the light emitting blocks, wherein the input data is m-bit data, the color compensating data is n-bit data, m and n are natural numbers, and n is greater than m, and wherein the PWM calculator determines the dimming levels using upper k-bits of the n-bit color compensating data, wherein k is a natural number less than n and equal to or greater than m.

8. The display apparatus of claim 7, further comprising: a light source driver driving the light emitting blocks using the dimming levels.

9. The display apparatus of claim 7, wherein the PWM calculator generates the compensating coefficient data including a luminance coefficient corresponding to the dimming levels and the light emitting blocks.

10. The display apparatus of claim 7, wherein the pixel compensator generates t-bit sub compensating data using the n-bit color compensating data received from the color compensator and the compensating coefficient data received from the PWM calculator, wherein t is a natural number and greater than n.

11. The display apparatus of claim 10, further comprising: a dithering unit dithering the t-bit sub compensating data to generate m-bit compensating data.

12. The display apparatus of claim 10, further comprising:

a dithering unit dithering the t-bit sub compensating data to generate m-bit compensating data for the present frame; and a frame compensator comparing the m-bit compensating data for the present frame with frame compensating data of a previous frame to generate frame compensating data of the present frame.

13. The display apparatus of claim 12, wherein the frame compensator comprises a memory storing the frame compensating data of the previous frame.

14. The display apparatus of claim 7, wherein the color compensator, the PWM calculator and the pixel compensator are integrally formed in one driving chip.

15. The display apparatus of claim 7, wherein the light source module comprises:

a light guiding plate disposed on a rear surface of the display panel; and a light emitting module disposed adjacent a longest side of the light guiding plate, and including the light emitting blocks arranged in a line.

16. The display apparatus of claim 7, wherein the light source module comprises:

a light guiding plate disposed on a rear surface of the display panel; and a light emitting module disposed adjacent a shortest side of the light guiding plate, and including the light emitting blocks arranged in a line.

17. The display apparatus of claim 7, wherein the light source module is disposed on a rear surface of the display panel, and includes the light emitting blocks arranged in a plurality of lines.

* * * * *